US005664501A

United States Patent [19]

Harris

[11] Patent Number: 5,664,501

[45] Date of Patent: Sep. 9, 1997

[54] POWER AND FREE CONVEYING SYSTEM

[75] Inventor: Hugh Harris, Trinidad, Colo.

[73] Assignee: Ford Motor Company, Dearborn, Mich.

[21] Appl. No.: 731,628

[22] Filed: Oct. 15, 1996

Related U.S. Application Data

[62] Division of Ser. No. 418,214, Apr. 6, 1995, Pat. No. 5,606,915.

[51] Int. Cl.[6] ..... B61B 10/00

[52] U.S. Cl. ..... 104/172.4

[58] Field of Search ..... 104/172.4, 172.3, 104/172.1, 89, 94, 95, 172.2

[56] References Cited

U.S. PATENT DOCUMENTS

| | | | |
|---|---|---|---|
| 1,062,314 | 5/1913 | Wittch | 104/172.4 |
| 2,973,721 | 3/1961 | Wagter . | |
| 3,477,390 | 11/1969 | Dolding . | |
| 3,726,234 | 4/1973 | Dema et al. | 104/172.4 |
| 3,793,965 | 2/1974 | Winters . | |
| 3,830,165 | 8/1974 | Turner . | |
| 3,861,323 | 1/1975 | Turner . | |
| 3,869,989 | 3/1975 | Pickstone . | |
| 3,906,867 | 9/1975 | Knudsen . | |
| 4,004,680 | 1/1977 | Warmann . | |
| 4,031,829 | 6/1977 | Bell et al. . | |
| 4,122,778 | 10/1978 | Di Rosa . | |
| 4,341,161 | 7/1982 | Morita et al. . | |
| 4,405,042 | 9/1983 | Dehne . | |
| 4,464,998 | 8/1984 | Wakabayashi . | |
| 4,474,286 | 10/1984 | Alexander . | |
| 4,475,462 | 10/1984 | Tsumaki et al. . | |
| 4,480,743 | 11/1984 | Dehne . | |
| 4,635,558 | 1/1987 | Hoehn . | |
| 4,640,196 | 2/1987 | Dehne . | |
| 4,646,650 | 3/1987 | Kondo et al. . | |
| 4,790,427 | 12/1988 | Dixon . | |
| 4,850,281 | 7/1989 | Kurek . | |
| 4,852,723 | 8/1989 | Ellens . | |
| 4,936,222 | 6/1990 | Murai . | |
| 5,009,168 | 4/1991 | Kuchta | 104/172.4 |
| 5,014,843 | 5/1991 | Linton et al. . | |
| 5,023,974 | 6/1991 | Coles . | |
| 5,363,770 | 11/1994 | Makinmra et al. . | |
| 5,400,717 | 3/1995 | Hoehn . | |
| 5,570,639 | 11/1996 | Hooper et al. | 104/172.4 |

FOREIGN PATENT DOCUMENTS

| | | | |
|---|---|---|---|
| 1295570 | 5/1962 | France | 104/172.4 |
| 2100253 | 11/1979 | Germany . | |
| 1256186 | 12/1971 | United Kingdom . | |

*Primary Examiner*—Mark T. Le
*Attorney, Agent, or Firm*—Daniel M. Stock, Esq.; Roger L. May, Esq.

[57] ABSTRACT

A power and free conveying system includes a track assembly having a power track and a free track spaced vertically from the power track, a power trolley supported on the power track for movement therealong and a free trolley supported on the free track for movement therealong. The free trolley includes a moveable holdback dog engageable and disengageable with the power trolley. The free trolley includes a retractable dog having a first position engageable with the power trolley and a second position disengageable with the power trolley and engageable with the holdback dog to completely disengage the free trolley from the power trolley upon engaging another one of the free trolley. The track assembly includes a C-shaped first side support member having an upper transverse end connected to the power track and a lower transverse end connected to the free track and a C-shaped second side support member opposite and spaced from the first side support member having an upper transverse end connected to the power track and a lower transverse end connected to the free track.

10 Claims, 8 Drawing Sheets

POWER AND FREE CONVEYING SYSTEM

This is a division of U.S. patent application Ser. No. 08/418,214, filed Apr. 6, 1995 now U.S. Pat. No. 5,606,915.

BACKGROUND OF THE INVENTION

1. Field Of the Invention

The present invention relates generally so conveying systems and, more specifically, to a power and free conveying system.

2. Description Of the Related Art

It is known to provide power and free conveyors in automotive assembly buildings for allowing assembly of automotive vehicles. Typically, a power and free conveying system includes a power track, a free track, a power trolley supported on the power track for movement therealong and a free trolley to support a load on the free track. The power trolley is typically chain driven and engages and disengages the free trolley to move the free trolley along the free track from one assembly station to another.

Various power and free conveyor manufacturers have their own unique standard design. These standard designs are not compatible with one another and each conveyor manufacturer has its own strengths and weaknesses. Due to the lack of standardization between conveyor manufacturers, parts from one power and free conveyor cannot be used on another power and free conveyor. As a result, there is a need in the art to provide a power and free conveyor which is modular in nature, thereby reducing cost, labor, field installation and start-up time.

SUMMARY OF THE INVENTION

Accordingly, the present invention is a power and free conveying system including a track assembly having a power track and a free track spaced vertically from the power track. The power and free conveying system also includes a power trolley supported on the power track for movement therealong and a free trolley supported on the free track for movement therealong. The free trolley also includes a moveable holdback dog engageable and disengageable with the power trolley. The free trolley includes a retractable dog having a first position engageable with the power trolley and a second position disengageable with the power trolley and engageable with the holdback dog to completely disengage the free trolley from the power trolley upon engaging another free trolley. The track assembly includes a C-shaped first side support member having an upper transverse end connected to the power track and a lower transverse end connected to the free track. The track assembly also includes a C-shaped second side support member opposite end spaced from the first side support member having an upper transverse end connected to the power track and a lower transverse end connected to the free track.

One feature of the present invention is that the power and free conveying system is modular in nature and allows the reuse of parts from one site to another or from one system in a building to another system in the building. Another feature of the present invention is that the power and free conveying system's modular design greatly reduces cost, time and labor required for field installation and start-up. Yet another feature of the present invention 15 that the power and free conveying system's modular design increases ease of installation, reliability and standardization. Still another feature of the present invention is that the power and free conveying system has a novel track assembly, pusher dogs, chain transfers and trolleys which overcome weaknesses in existing power and free conveyors. Further features of the present invention are that the free trolley has increased dog bite for more positive engagement with the chain, longer wheelbase for improved trolley stability and removable side guide rollers for ease of maintenance. Still other features of the present invention are that the track assembly has a torsionally stiff guard support member on top of the track to prevent rail twist, common rails on both power and free tracks, and bolted track splices to eliminate field welding and reduce installation time. More features of the present invention are that the track assembly is able to span twenty-five feet without additional support and has double the carrying capacity of existing conveyors.

Other features and advantages of the present invention will be readily appreciated as the same becomes better understood after reading the subsequent description when considered in connection with the accompanying drawings.

BRIEF DESCRIPTION OF THE DRAWINGS

FIG. 6 is a sectional view taken along line 6—6 of FIG. 5.

FIG. 8 is a fragmentary front view of a portion of the power and free conveying system of FIG. 1 illustrating two trolleys before engagement.

DESCRIPTION OF THE PREFERRED EMBODIMENT(S)

Figure 1:
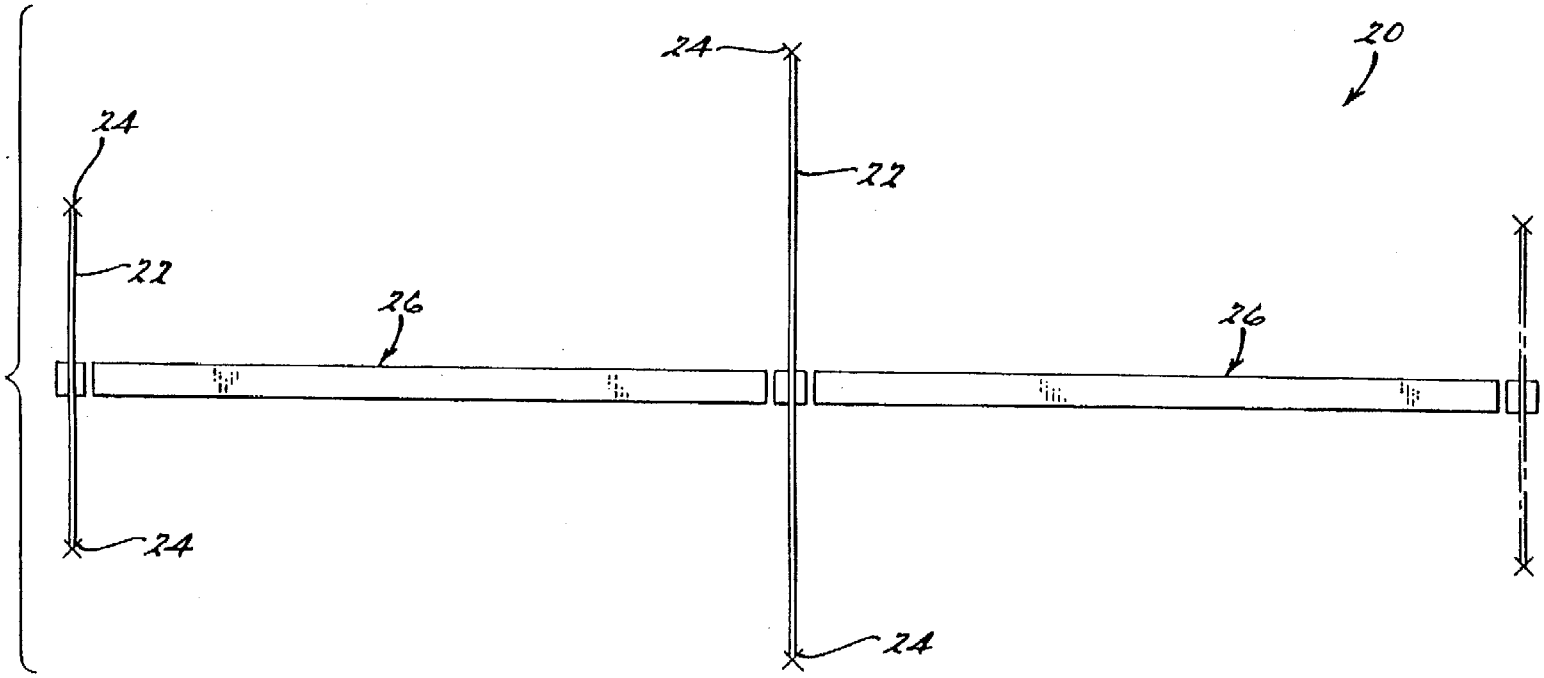
FIG. 1 is a plan view of a power and free conveying system, according to the present invention illustrated in a bay of a building.
Figure 2:
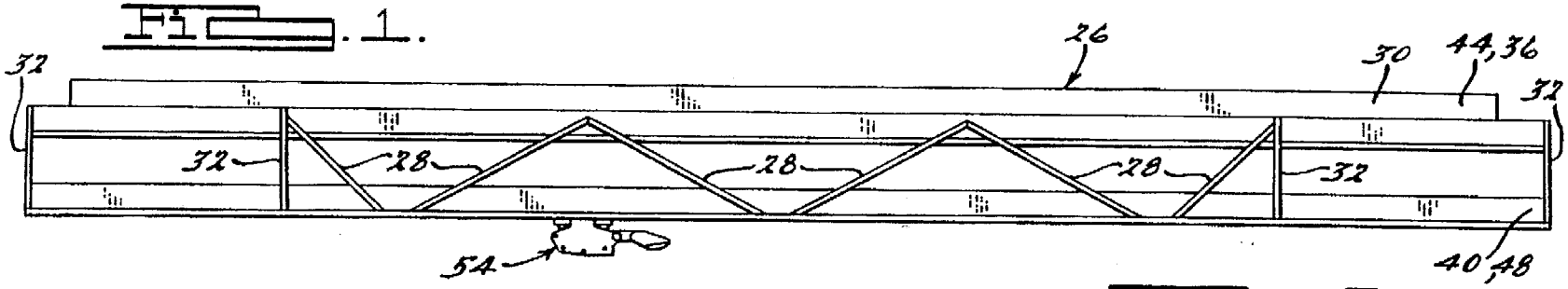
FIG. 2 is an enlarged front view of a portion of the power and free conveying system of FIG. 1.

Referring to the drawings and in particular to FIGS. 1 and 2, a power and free conveying system 20, according to the present invention, is illustrated in overhead relationship in a bay of a building. The power and free conveying system 20 may be supported in a typical forty (40) feet bay by two (2) headers 22 and four (4) hangers 24. It should be appreciated that only a portion of the power and free conveying system 10 is illustrated in FIG. 1.

Figure 3:
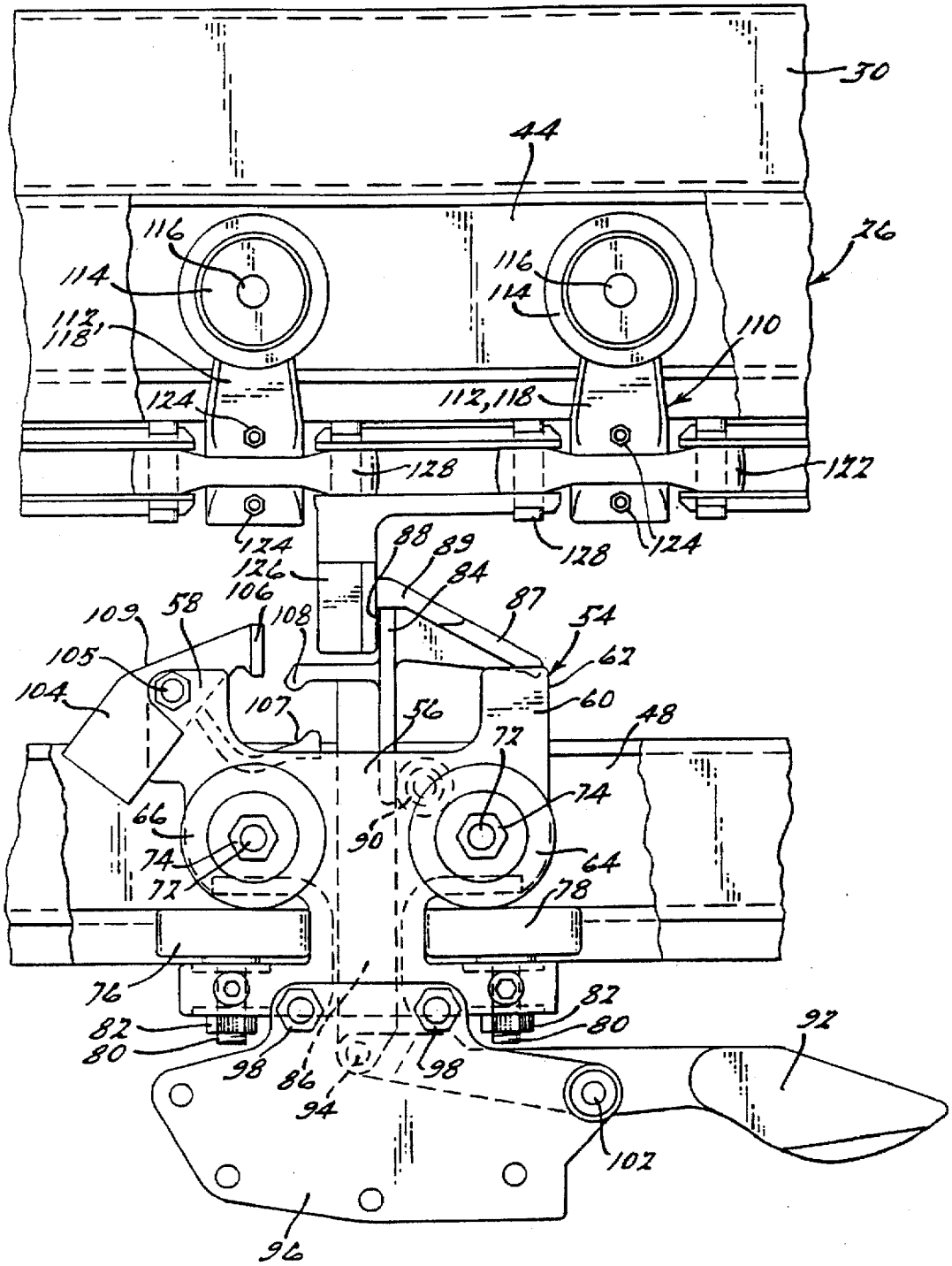
FIG. 3 is an enlarged fragmentary front view of a portion of the power and free conveying system of FIG. 1.
Figure 4:
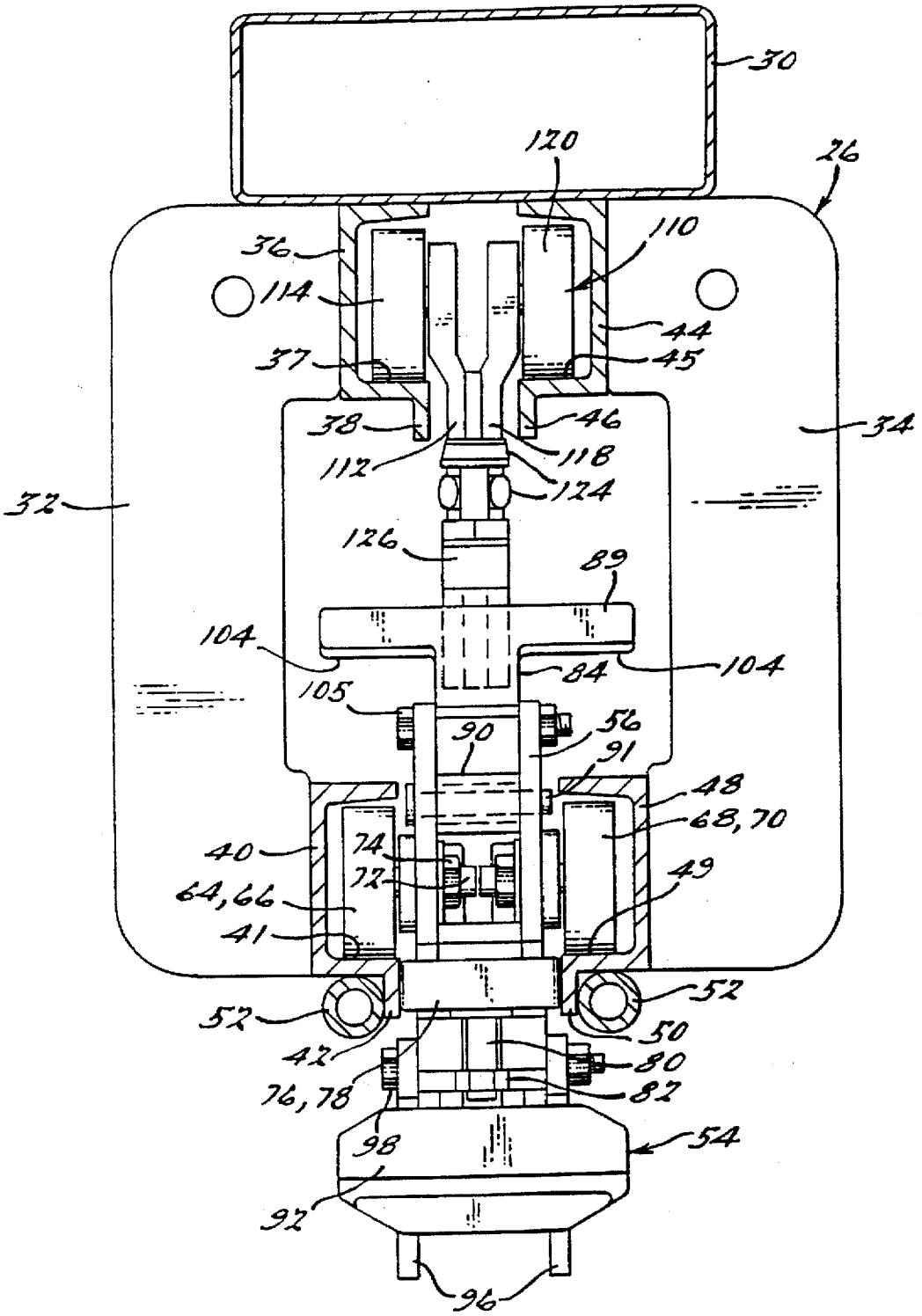
FIG. 4 is a side view of the portion of the power and free conveying system of FIG. 3.

The power and free conveying system 20 includes a track assembly, generally indicated at 26, supported between the headers 22. The track assembly 26 includes a plurality of track yokes 28 installed on diagonals to form a truss to allow the track assembly 26 to span up to twenty-five (25) feet between the headers 22 overhead in the bay. As illustrated in FIGS. 2 through 4, the track assembly 26 also includes an upper guard support member 30 secured to the headers 22 by suitable means such as welding. The guard support member 30 is tubular and generally rectangular in cross-section. The guard support member 30 is torsionally stiff to prevent track or rail twist and eliminate additional supports.

The track assembly 26 further includes at least one, preferably a plurality of first side support members 32 disposed along and secured to the upper support member 30. The first side support member 32 has a generally C-shaped cross-section and is secured to the guard support member 30 by suitable means such as welding. The track assembly 26 includes at least one, preferably a plurality of second side support member 34 spaced transversely from the first side support member 32 and disposed along and secured to the upper support member 30 opposite the first side support member 32. The second side support member 34 has a generally C-shaped cross-section and is secured to the guard support member 30 by suitable means such as welding. It should be appreciated that the track yokes 28 have a vertically orientated first and second side support member 32 and 34 at each end of the truss formed by the track yokes 28.

The first side support member 32 includes a first or upper power track member or rail 36 at a transverse end of an upper portion thereof. The upper power track member 36 has a generally C-Shaped cross-section with a flat interior wheel engaging or track surface 37 on a lower portion thereof for engagement by power trolley wheels 114 to be described. The first power track member 36 also has a downstanding flange 38 at a transverse end of the lower portion thereof. The first side support member 32 also includes a first or lower free track member 40 at a transverse end of a lower portion thereof. The first free track member 40 has a generally C-shaped cross-section with a flat interior wheel engaging or track surface 41 on a lower portion thereof for engagement by free trolley wheels 64,66 to be described. The first free track member 40 also has a downstanding flange 42 at a transverse end of the lower portion thereof.

The second side support member 34 includes a second or upper power track member 44 at a transverse end of an upper portion thereof and spaced transversely from the first-power track member 36. The second power track member 44 has a generally C-shaped cross-section with a flat interior wheel engaging or track surface 45 on a lower portion thereof for engagement by power trolley wheels 120 to be described. The second power track member 44 also has a downstanding flange 46 at a transverse end of the lower portion thereof. The second side support member 34 also includes a second or lower free track member 48 at a transverse end of a lower portion thereof and spaced transversely from the first free track member 40. The second free track member 48 has a generally C-shaped cross-section with a flat interior wheel engaging or track surface 49 on the lower portion thereof for engagement by free trolley wheels 68,70 to be described. The second free track member 48 also has a downstanding flange 50 at a transverse end of the lower portion thereof. It should be appreciated that the width of the free track is greater than the width of the power track for increased stability and that the track members 36,40,44,48 may be interchangeable.

Figure 9:
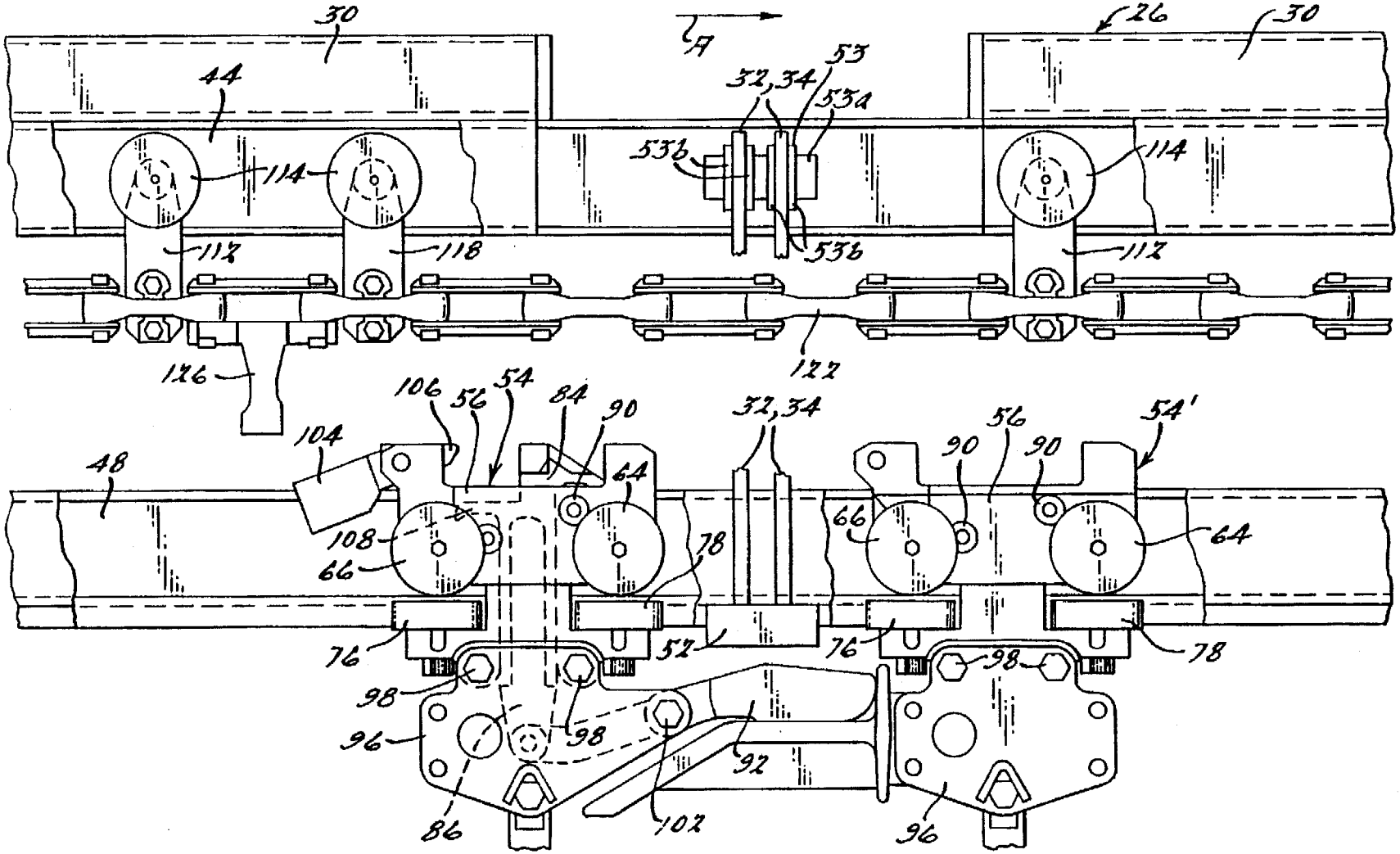
FIG. 9 is a view similar to FIG. 8 illustrating the two trolleys after engagement.

The track assembly 26 further includes track splices 52 to splice together pairs of sections thereof as illustrated in FIGS. 8, and 9. The track splices 52 are tubular and extend longitudinally. The track splices 52 are disposed beneath and abut the lower portion of each free track-member 40,48 and the downstanding flange 42,50. The track splices 52 are secured to the first and second side support members 32 and 34 by fasteners 53 such as bolts **53*a* and nuts 53*b*. It should be appreciated that the track splices 52** eliminate field welding and reduce installation time.

The power and free conveying system 10 also includes at least one, preferably a plurality of free trolleys, generally indicated at 54, for movement along the track assembly 26.

The free trolley 54 has a trolley body 56 with transversely spaced first upstanding projections 58 and second upstanding projections 60 spaced longitudinally from the first upstanding projection 58 at an upper end thereof. The second upstanding projection 60 has a forward surface 62 fixed relative to the trolley body 56 for engagement with a stop blade (not shown).

The free trolley 54 includes forward and rear first free trolley wheels 64 and 66, respectively, for engaging the first free track member 40 and forward and rear second free trolley wheels 68 and 70 respectively, for engaging the second free track member 48. Each of the trolley wheels 64,66, and 68,70 has a flat face to engage the track surfaces 41 and 49, respectively, and eliminate track spreading forces. Each of the free trolley wheels 64,66,68,78 are of the ball bearing type having a shaft 72 extending transversely through the trolley body 56 and secured thereto by nuts 74. It should be appreciated that any suitable means may be used to secure the free trolley wheels 64,66,68,70 to the trolley body 56. It should also be appreciated that the free trolley wheels 64,66,68,70 are easily removeable from the free trolley 54.

The free trolley 54 may include forward and rear side guide rollers 76 and 78 disposed between the downstanding flanges 42 and 50 for engaging the downstanding flanges 42 and 50 of the first and second free track members 40 and 48, respectively. Each of the side guide rollers 76,78 are of the ball bearing type having a shaft 80 extending downwardly through the trolley body 56 and secured thereto by nuts 82. It should be appreciated that the side guide rollers 76, 78 are removable for ease of maintenance.

The free trolley 54 also includes a retractable dog 84 having a leg portion 86 extending downwardly through the trolley body 56. The retractable dog 84 has a cam face 87 and shoulder face 88 to engage a cam down bar 132 and chain pusher dog 126, respectively, to be described. The retractable dog 84 also has a dog portion 89 extending transversely a predetermined width for increased dog bite. It should be appreciated that the dog portion 89 is sufficiently wide to eliminate auxiliary devices at chain to chain transfers to be described.

The leg portion 86 of the retractable dog 84 is disposed between a front force guide roll 90 and a rear force guide roll to prevent longitudinal movement thereof. The guide roll 90 is rotatably secured to the trolley body 56 by a pin 91. It should be appreciated that any suitable means may be used to rotatably secure guide roll 90 to the trolley body 56 to resist the retractable dog 84 from sticking in a retracted position.

The free trolley 54 further includes an actuating lever 92 rotatably secured by a fastener 94 to a lower portion of the leg portion 86. The free trolley 54 includes a pair of side plates 96 secured to the trolley body 56 by fasteners 98. The actuating lever 92 is rotatably secured between the side plates 96 by suitable means such as a fastener 102. It should be appreciated that, when the actuating lever 92 is moved upwardly, the leg portion 86 moves downwardly to cause the retractable dog 84 to be retracted.

The free trolley 54 also includes a holdback dog 104 rotatably secured between the projections 58 by suitable means such as a fastener 105. The holdback dog 104 has a dog portion 106 which may engage the chain pusher dog 106 to be described. The holdback dog 104 also has an actuated flange 107 which may be engaged by a corresponding actuator flange 108 of the leg portion 86 of the retractable dog 84 to rotate the holdback dog 104. The holdback dog 104 also has a cam surface 109 for engagement with a cam down bar 132 to be described to rotate the dog portion 106 downwardly. It should be appreciated that the retractable dog 84 and holdback dog 104 resist the chain pusher dog 106 from disengaging the free trolley 54.

The power and free conveying system 10 includes at least one, preferably a plurality of power trolleys, generally indicated at 110, for movement along the track assembly 26. The power trolley 110 includes a first power trolley support 112 having a first power trolley wheel 114 rotatably secured to an upper portion thereof by suitable means such as a pin 116. The first power trolley wheel 114 has a flat face to engage the track surface 37 of the first power track member 36. The power trolley 110 also includes a second power trolley support 118 spaced transversely from the first power trolley support 112 and having a second power trolley wheel 120 rotatably secured to an upper portion thereof by suitable means such as a pin 116. The second power trolley wheel 120 has a flat face to engage the track surface 45 of the second power track member 44.

The power trolley 110 also includes a chain 122 for engaging the power trolley supports 112,118. The power trolley supports 112,118 extend through the chain 122 and are secured to each other by suitable means such as fasteners 124 above and below the chain 122. The power trolley 110 also includes a chain dog pusher 126 disposed between a pair of power trolley supports 112,118 and secured to the chain 122 by suitable means such as fasteners 128. The chain dog pusher 126 engages the retractable dog 84 to move the free trolley 54 along the track assembly 26. It should be appreciated that the chain 122 is attached to a power source (not shown) to move the chain 122 along the track assembly 26.

Figure 5:
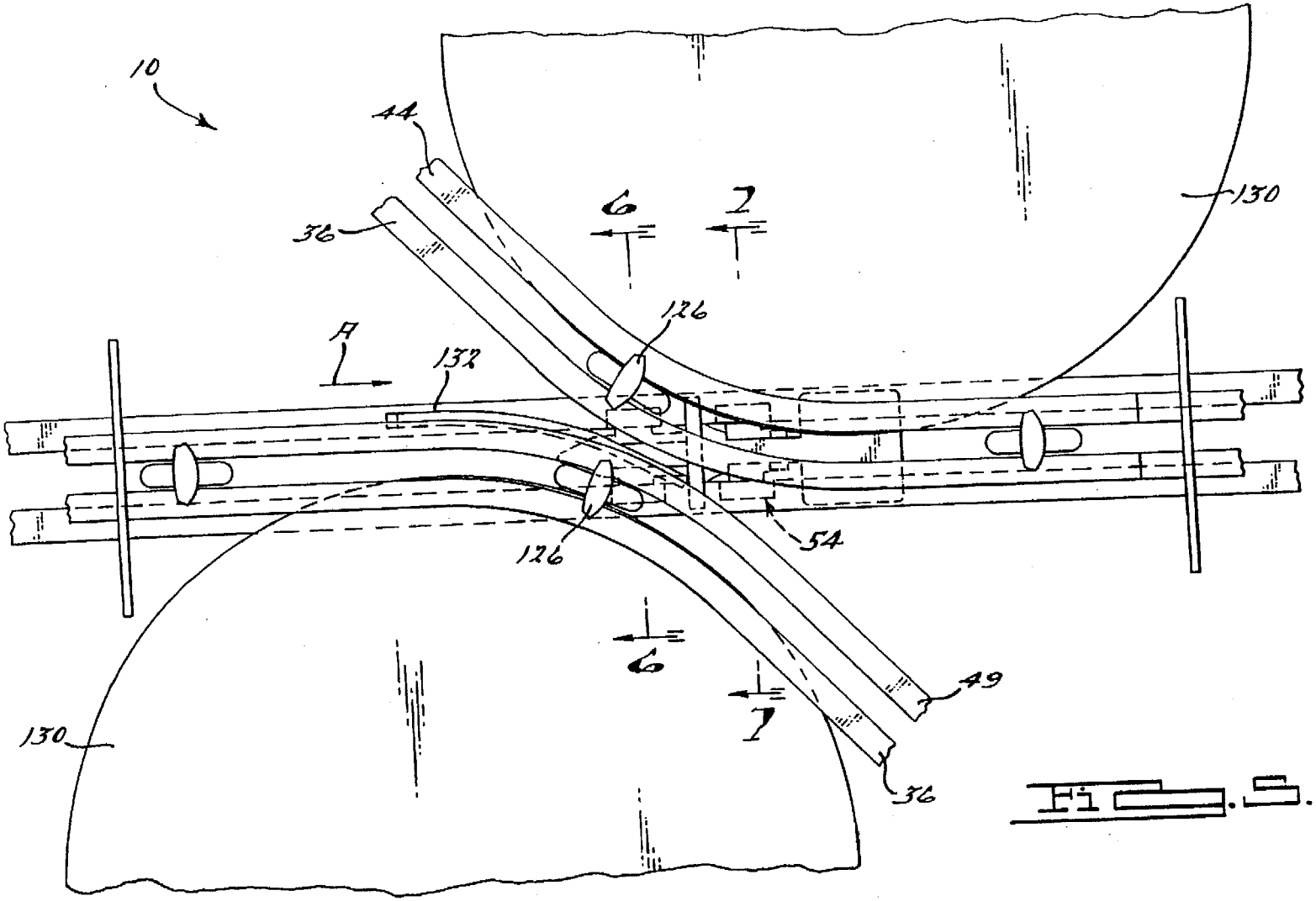
FIG. 5 is a plan view of a transfer mechanism of the power and free conveying system of FIG. 1.
Figure 5:
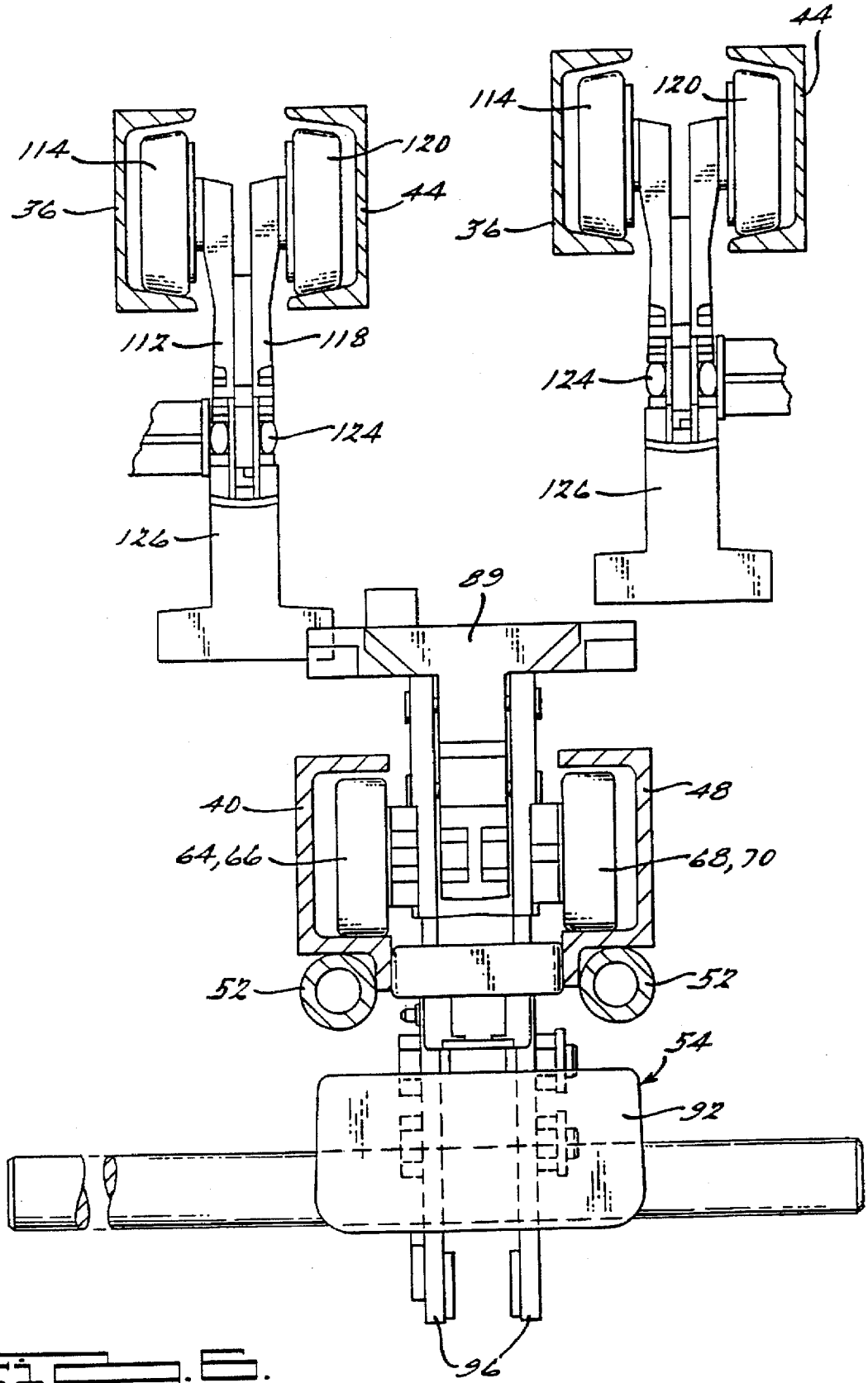
Figure 7:
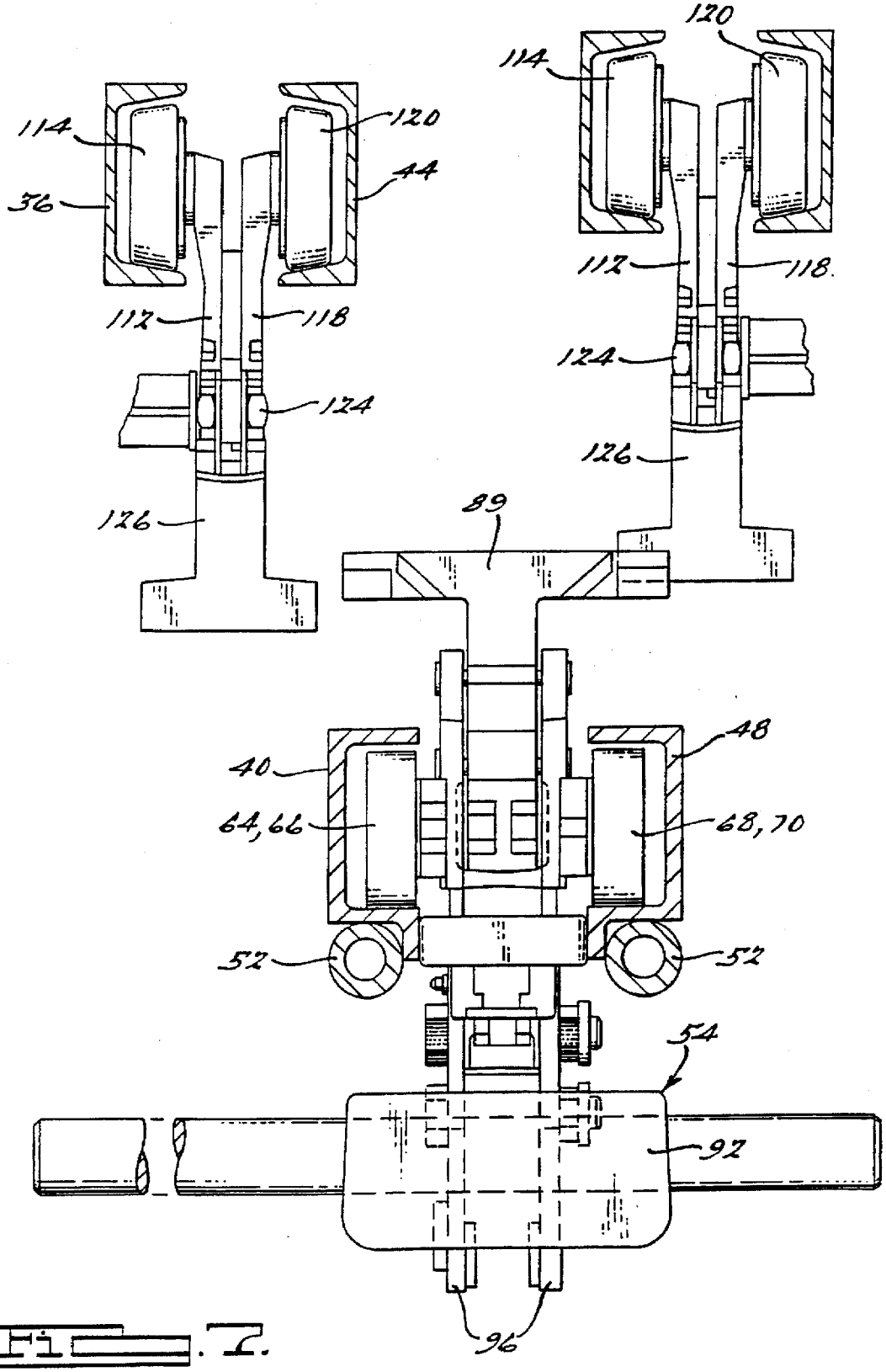
FIG. 7 is a sectional view taken along line 7—7 of FIG. 5.
Figure 7:
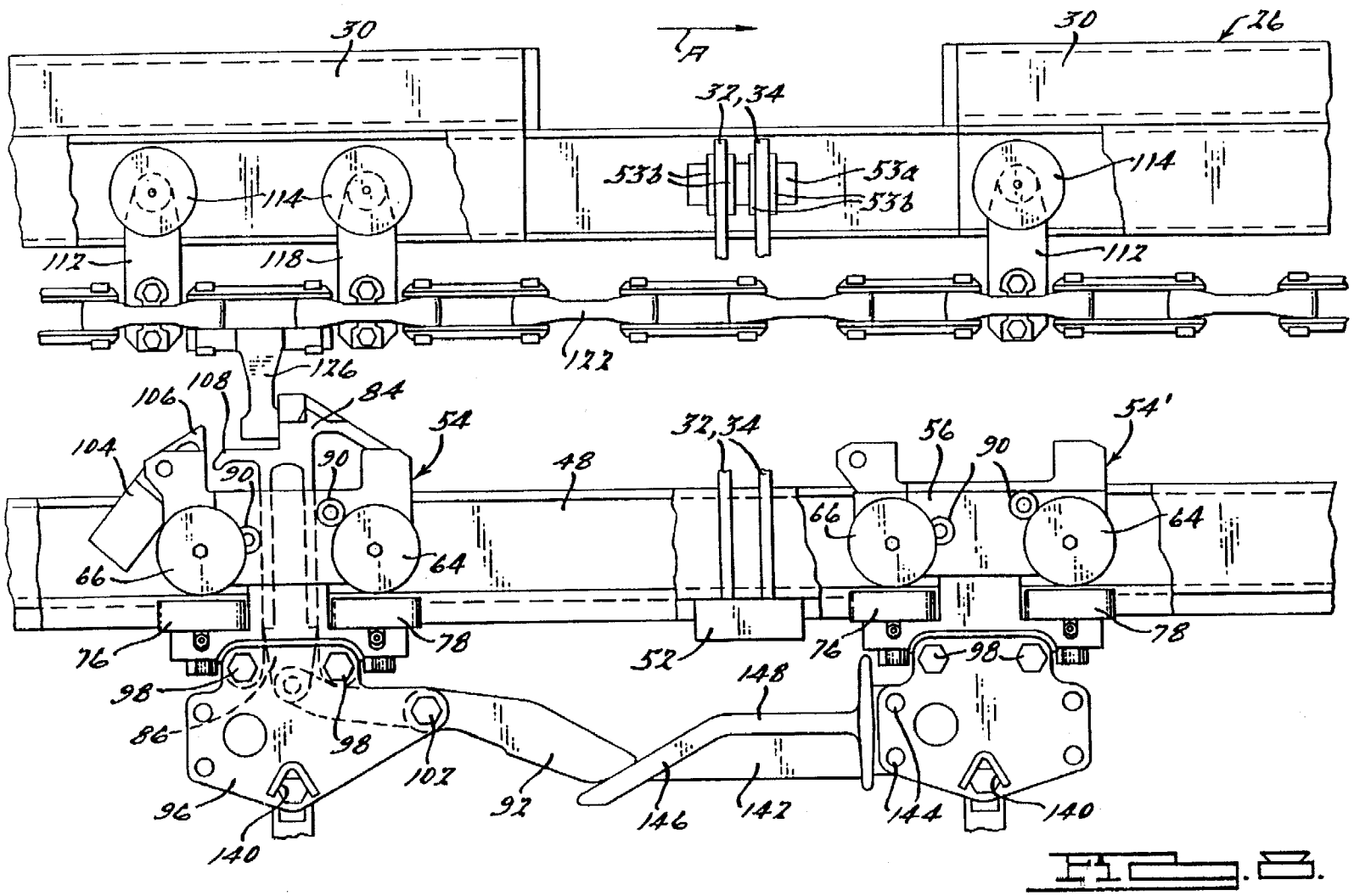

Referring to FIG. 5, the power and free conveying system 10 may include at least one, preferably a pair of traction wheels 130 at a curved section of the track assembly 26. As illustrated, the traction wheels 130 are disposed along opposed curved sections of the power track to transfer the free trolley 54 from one power track to the other. As illustrated in FIG. 6, the wipe out power trolley 110 has the chain pusher dog 126 engaging the retractable dog 84 of the free trolley 54. As the chain 122 of the wipe out power trolley 110 moves in the direction indicated by the arrow A in FIG. 5, the cam surface 87 of the retractable dog 84 engages a cam down bar 132 disposed along the curved section of the wipe out power track and- the retractable dog 84 moves downwardly or retracts. As this occurs, the chain pusher dog 126 of the wipe out power trolley 110 disengages the free trolley 54 and moves along the traction wheel 130. As illustrated in FIG. 7, the wipe in power trolley 110 moves along the other traction wheel 130 and the cam down bar 132 ends to allow the retractable dog 84 to extend or move upwardly. The wipe in power trolley 110 has its chain pusher dog 126 engage the retractable dog 84 to move the free trolley 54 along the free tracks 40,48. It should be appreciated that FIGS. 5 through 7 illustrate a typical chain to chain transfer. It should also be appreciated that the traction wheels 130 may have teeth on a circumference thereof to engage the chain 122.

Referring to FIGS. 8 and 9; a pair of free trolleys 54 and 54' are illustrated before engagement on the power and free conveying system 10. A first free trolley 54 is shown with a king pin 140 to attach a load to the side plates 96. The king pin 140 is conventional and known in the art. A second free trolley 54' lacks a retractable dog and holddown dog. The second free trolley 54' also has a cam actuator 142 secured between and to the side plates 96 by suitable means such as fasteners 144. The cam actuator 142 has a cam portion 146 extending downwardly at an angle to contact the actuating lever 92 and a longitudinal rest portion 148 as illustrated in FIG. 8. As the power trolley 110 moves in a direction of travel as indicated by the arrow A, the actuating lever 92 moves upwardly along the cam portion 146 of the cam actuator 142. As this occurs, the actuating lever 92 rotates to pull down or retract the retractable dog 84. The flange 108 of the retractable dog 84 engages the flange 107 of the holdback dog 104 to rotate the dog portion 106 downwardly. Once the actuating lever 92 reaches the rest portion 148 of the cam actuator 142 as illustrated in FIG. 9, the retractable dog 84 and holdback dog 104 have retracted sufficiently to disengage completely the chain pusher dog 126. It should be appreciated that the cam actuator 142, retractable dog 84 and holdback dog 104 are optional features for the free trolley 54.

Accordingly, the free trolley 54 has increased dog bite for more positive engagement with the chain 122, and more positive transfers due to improved design of wide front trolley dog, chain dog and method of transferring. The free trolley 54 has a longer wheel base for improved trolley stability and rollers 90 for guiding the retractable dog 84 to resist the retractable dog 84 from sticking down, causing missed transfers.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A power and free conveying system comprising:

a track assembly including a power track and a free track vertically spaced from said power track;

a power trolley supported on said power track for movement therealong;

a free trolley supported on said free track for movement therealong;

said track assembly including a C-shaped first side support member having an upper transverse end connected to said power track and a lower transverse end connected to said free track and a C-shaped second side support member opposite and spaced from said first side support member having an upper transverse end connected to said power track and a lower transverse end connected to said free track.

2. A power and free conveying system as set forth in claim 1 wherein said power track has a transverse width less than a transverse width of said free track.

3. A power and free conveying system as set forth in claim 2 wherein said power track and said free track each comprises a C-shaped first track member having a downstanding flange at a transverse end of a lower portion thereof and a C-shaped second track member spaced transversely from said first track member and having a downstanding flange at a transverse end of a lower portion thereof.

4. A power and free conveying system a set forth in claim 1 including a torsionally stiff guard support member secured to said first and second side support members.

5. A power and free conveying system as set forth in claim 4 wherein said guard support member is tubular and generally rectangular in shape.

6. A power and free conveying system as set forth in claim 3 wherein said first and second track members each has planar and parallel interior lower surfaces to be engaged by said trolleys.

7. A power and free conveying system as set forth in claim 1 including track yokes positioned diagonally between said power track and said free track to form a truss.

8. A power and free conveying system as set forth in claim 3 splicing members for connecting sections of said first track member and sections of said second track member.

9. A power and free conveying system as set forth in claim 8 including a torsionally stiff guard support member secured to said first and second side support members.

10. A power and free conveying system as set forth in claim 9 wherein said track members of said polar track are C-shaped.

* * * * *